US009172193B2

(12) United States Patent
Sakamoto

(10) Patent No.: US 9,172,193 B2
(45) Date of Patent: Oct. 27, 2015

(54) JOINT CONNECTOR EXTENDING STRUCTURE AND JOINT CONNECTOR

(71) Applicant: Yazaki Corporation, Minato-ku, Tokyo (JP)

(72) Inventor: Nobuyuki Sakamoto, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 70 days.

(21) Appl. No.: 13/913,562

(22) Filed: Jun. 10, 2013

(65) Prior Publication Data

US 2013/0337696 A1 Dec. 19, 2013

(30) Foreign Application Priority Data

Jun. 15, 2012 (JP) ..... 2012-135565

(51) Int. Cl.

| | |
|---|---|
| ***H01R 9/03*** | (2006.01) |
| ***H01R 31/08*** | (2006.01) |
| ***H01R 24/28*** | (2011.01) |
| *H01R 13/11* | (2006.01) |

(52) U.S. Cl.

CPC ..... *H01R 24/28* (2013.01); *H01R 31/08* (2013.01); *H01R 13/112* (2013.01)

(58) Field of Classification Search

CPC .... H01R 31/08; H01R 9/2675; H01R 9/2458; H01R 13/514; H01R 2107/00

USPC ..... 439/658, 701, 752, 507, 511

See application file for complete search history.

(56) References Cited

U.S. PATENT DOCUMENTS

| | | | | | |
|---|---|---|---|---|---|
| 5,356,302 | A * | 10/1994 | Inoue et al. | ..... | 439/189 |
| 5,556,301 | A * | 9/1996 | Chishima et al. | ..... | 439/507 |
| 5,562,487 | A * | 10/1996 | Ii et al. | ..... | 439/495 |
| 6,666,729 | B2 * | 12/2003 | Takamura et al. | ..... | 439/723 |
| 7,241,168 | B2 * | 7/2007 | Sakurai et al. | ..... | 439/511 |
| 7,883,362 | B2 * | 2/2011 | Ichio et al. | ..... | 439/511 |
| 8,083,543 | B2 * | 12/2011 | Omori et al. | ..... | 439/511 |
| 2003/0119345 | A1 | 6/2003 | Wu | | |
| 2014/0287621 | A1 * | 9/2014 | Smutny et al. | ..... | 439/574 |

FOREIGN PATENT DOCUMENTS

| | | | |
|---|---|---|---|
| CN | 1574507 | A | 2/2005 |
| JP | S61-068487 | U | 5/1986 |
| JP | 2004-031178 | A | 1/2004 |
| JP | 2007-87810 | A | 4/2007 |

OTHER PUBLICATIONS

The office action letter issued on Mar. 10, 2015 in the counterpart Chinese patent application.

* cited by examiner

*Primary Examiner* — Xuong Chung Trans

(74) *Attorney, Agent, or Firm* — Marvin A. Motsenbocker; Mots Law, PLLC

(57) ABSTRACT

A joint connector extending structure includes first and second connector terminals, first and second housings for housing the first and second connector terminals, and a joint connector configured to fit in first and second cutouts of the first and second housings laid on top of one another to engage with male contacts of the first and second connector terminals housed in the first and second housings thereby to conduct the first and second connector terminals and integrate the first and second housings.

20 Claims, 5 Drawing Sheets

JOINT CONNECTOR EXTENDING STRUCTURE AND JOINT CONNECTOR

CROSS REFERENCE TO RELATED APPLICATION

This application is based upon and claims the benefit of priority from the prior Japanese Patent Application No. 2012-135565, filed on Jun. 15, 2012, the entire contents of which are incorporated herein by reference.

BACKGROUND

1. Technical Field

The present invention relates to a joint connector extending structure and a joint connector, and particularly to a joint connector for integrally connecting housings laid on top of one another.

2. Related Art

There is proposed, in Patent Literature 1, that connector terminals are arranged at ends of a plurality of electric wires, respectively, and the connector terminals are mutually connected thereby to secure conductivity between the electric wires.

As illustrated in FIG. 1, each connector terminal 301 may be inserted and housed in a connector terminal housing 305 provided with as many housing holes 303 as the connector terminals 301, thereby connecting the electric wires. In FIG. 1, TD indicates a traverse direction, LD indicates a longitudinal direction, FRD is a forward/rearward direction, FR indicates a forward side, and RR indicates a rearward side.

CITATION LIST

Patent Literature

Patent Literature 1: Japanese Patent Application Laid-Open No. 2007-87810 Publication

SUMMARY

The housing 305 made of resin cannot be easily changed in the number of housing holes 303 provided thereon. Thus, when more connector terminals 301 than the housing holes 303 provided on the housing 305 are mutually connected, another housing with a different specification (that is, with more housing holes) is required.

It is an object of the present invention to provide a joint connector extending structure and a joint connector capable of mutually connecting more connector terminals without changing the number of housing holes for housing the connector terminals on a housing.

A joint connector extending structure in accordance with some embodiments includes: a plurality of connector terminals each having a main body and a male contact protruding from the main body at one side of a traverse direction of the main body; a first housing for housing a first connector terminal of the plurality of connector terminals and having a first cutout through which the male contact of the first connector terminal housed in the first housing is visible; a second housing for housing a second connector terminal of the plurality of connector terminals and having a second cutout through which the male contact of the second connector terminal housed in the second housing is visible; and a joint connector configured to fit in the first and second cutouts of the first and second housings laid on top of one another to engage with the male contact of the first connector terminal housed in the first housing and the male contact of the second connector terminal housed in the second housing thereby to conduct the first and second connector terminals and integrate the first and second housings.

Each of the plurality of connector terminals may have a female contact inside the main body, the first housing may house the first connector terminal and a third connector terminal of the plurality of connector terminals adjacently in the traverse direction, the male contact of the first connector terminal housed in the first housing and the female contact of the third connector terminal housed in the first housing may be engaged with each other to be conducted, the male contact of the first connector terminal housed in the first housing may be positioned at one end of the traverse direction of the first housing, and the male contact of the second connector terminal housed in the second housing may be positioned at one end of the traverse direction of the second housing.

A joint connector in accordance with some embodiments is used for laying and jointing on top of one another a first housing and a second housing. The first housing is for housing a first connector terminal of a plurality of connector terminals each having a main body and a male contact protruding from the main body at one side of a traverse direction of the main body and having a first cutout through which the male contact of the first connector terminal as housed is visible. The second housing is for housing a second connector terminal of the plurality of connector terminals and having a second cutout through which the male contact of the second connector terminal as housed is visible. The joint connector includes: a first engagement part configured to fit in the first cutout of the first housing to engage with the male contact of the first connector terminal housed in the first housing; a second engagement part configured to fit in the second cutout of the second housing to engage with the male contact of the second connector terminal housed in the second housing; and a coupling part connecting the first engagement part and the second engagement part. The joint connector installed in the first and second housings entirely fits in the first and second cutouts of the first and second housings to conduct the first and second connector terminals and integrate the first and second housings.

The joint connector may have a U-shape.

According to the above structure, with the joint connector extending structure and the joint connector for mutually connecting a plurality of connector terminals, more connector terminals can be mutually connected without changing the number of housing holes for housing the connector terminals on the housings.

DETAILED DESCRIPTION

Figure 1:
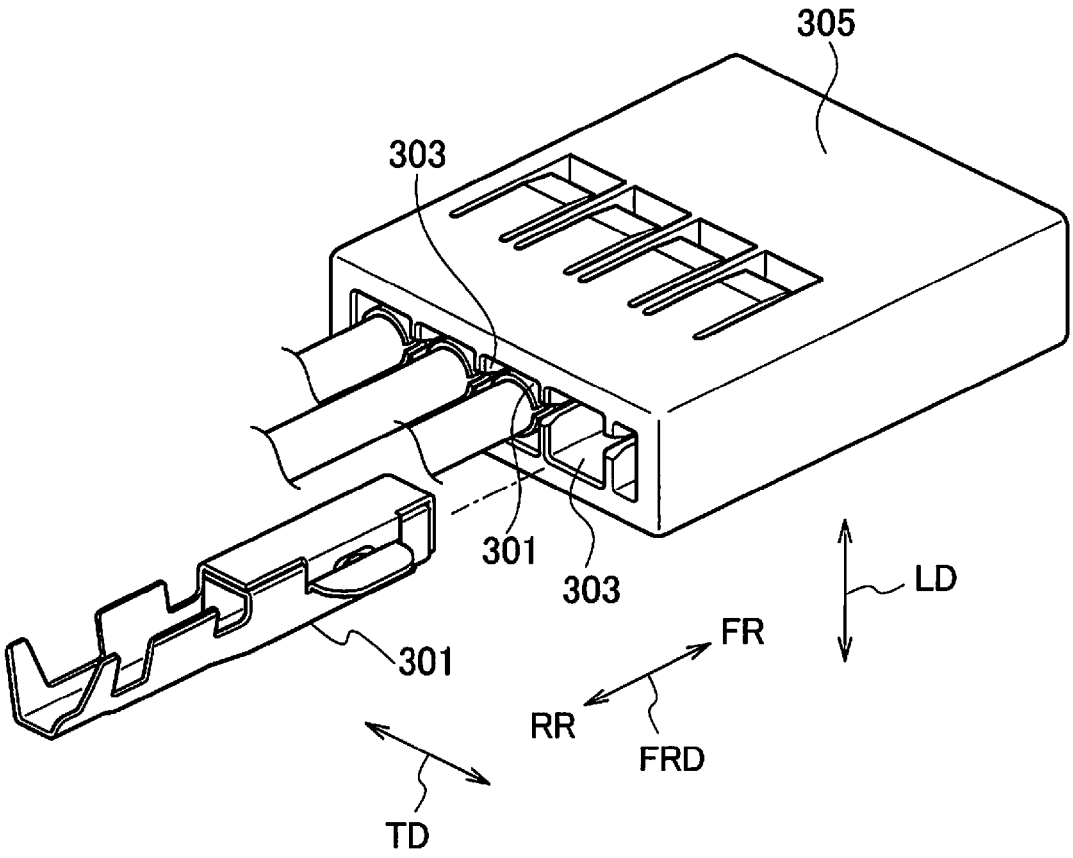
FIG. 1 RELATED ART
FIG. 1 is a perspective view illustrating a related housing and joint terminals.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
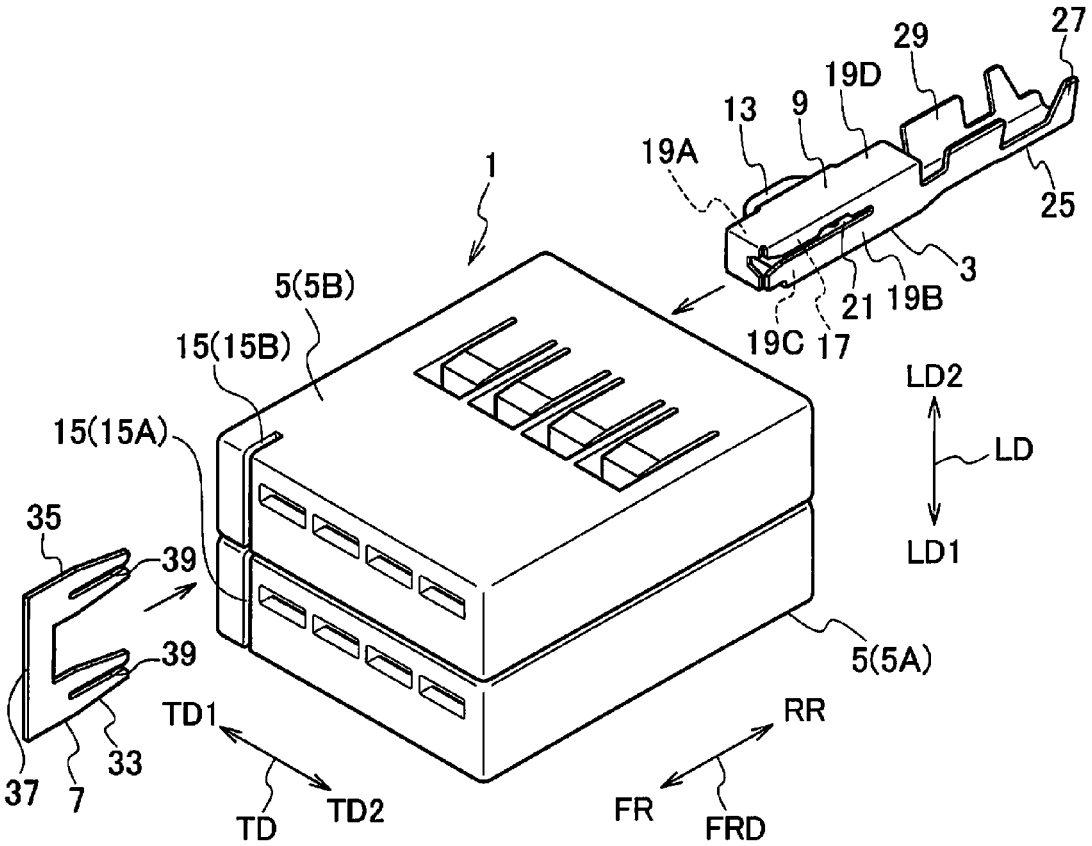
FIG. 2 is a perspective view illustrating a schematic structure of a joint connector extending structure according to an embodiment of the present invention.

A joint connector extending structure 1 and a joint connector 7 according to an embodiment of the present invention will be described below in detail with reference to FIGS. 2 to 6. The joint connector extending structure 1 comprises connector terminals 3, a first housing 5 (5A), a second housing 5 (5B) and a joint connector 7 as illustrated in FIG. 2 and the like. The housing (connector terminal housing) 5 is provided with housing holes 11 for housing the connector terminals 3.

For convenience of the description, the longitudinal direction of the connector terminal 3 or the housing hole 11 of the housing 5 is assumed as a forward/rearward direction FRD, the forward side of the forward/rearward direction FRD is assumed as FR, and the rearward side of the forward/rearward direction FRD is assumed as RR. One direction orthogonal to the forward/rearward direction FRD is assumed as a traverse direction TD, and one end of the traverse direction TD is assumed as TD1, and the other end of the traverse direction TD is assumed as TD2. A direction orthogonal to the forward/rearward direction FRD and the traverse direction TD is assumed as a longitudinal direction LD, and one end of the longitudinal direction LD is assumed as LD1, and the other end of the longitudinal direction LD is assumed as LD2.

Figure 6:
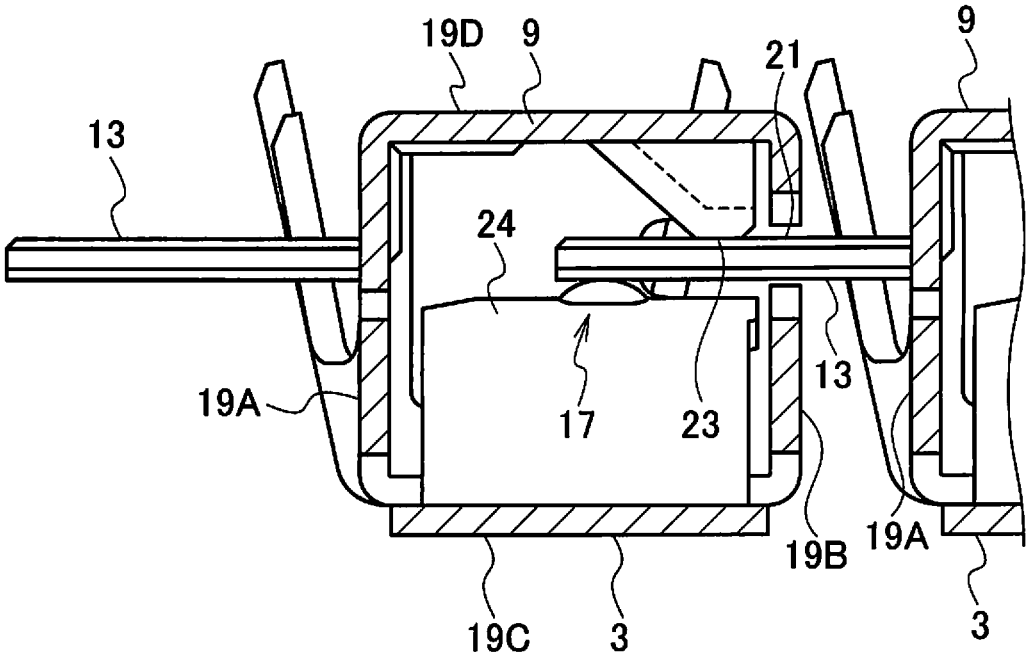
FIG. 6 is a plan view developing in the longitudinal direction and in the traverse direction (plan orthogonal to the forward/rearward direction), which is a cross section view taken along the state where the joint terminals are mutually engaged in the joint connector extending structure according to the embodiment of the present invention.

The connector terminal 3 comprises a main body 9, and a male contact 13 protruding from the main body 9 on one side of the traverse direction TD of the main body 9 as illustrated in FIG. 6 and the like.

The first housing 5A is formed in a rectangular plate shape. The connector terminals 3 are inserted and housed in the housing holes 11 in the first housing 5A. The first housing 5A is formed with a cutout (such as slit) 15 (15A) through which the male contact 13 of the housed connector terminal 3 is visible.

The second housing 5B is also formed in a rectangular plate shape similarly to the first housing 5A. The connector terminals (different connector terminals from the connector terminals to be housed in the first housing 5A) 3 are inserted and housed in the housing holes 11 in the second housing 5B. The second housing 5B is also formed with a cutout (such as slit) (15B) through which the male contact 13 of the housed connector terminal 3 is visible.

In the present embodiment, the number of housing holes 11 in the first housing 5A is the same as the number of housing holes 11 in the second housing 5B, but may be different therefrom.

Figure 3:
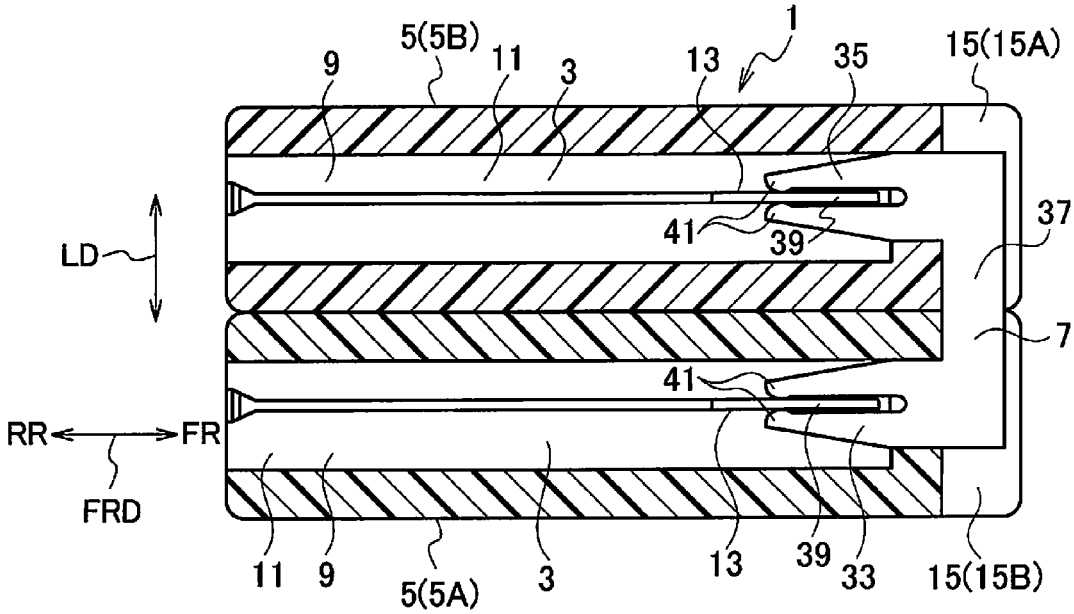
FIG. 3 is a cross-section view of the joint connector extending structure according to the embodiment of the present invention taken along the plan developing in the longitudinal direction and in the forward/rearward direction (plan orthogonal to the traverse direction)
Figure 4:
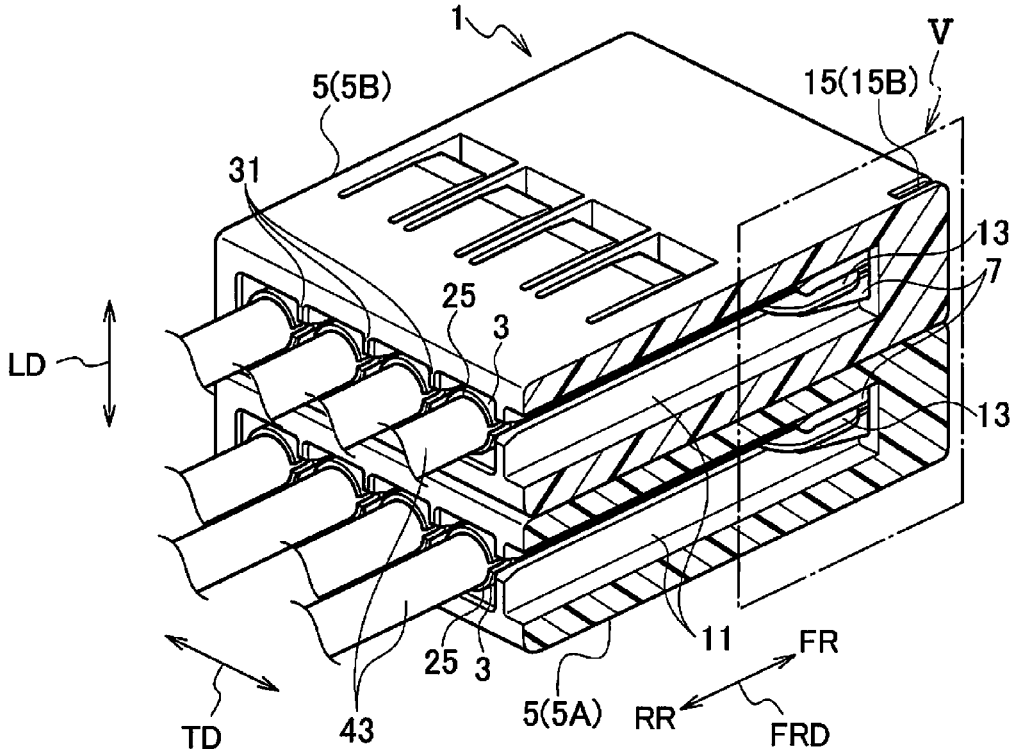
FIG. 4 is a perspective view illustrating a schematic structure of the joint connector extending structure according to the embodiment of the present invention, which is a cross-section view near a slit (a cross-section view taken along the plan developing in the longitudinal direction and in the forward/rearward direction)
Figure 5:
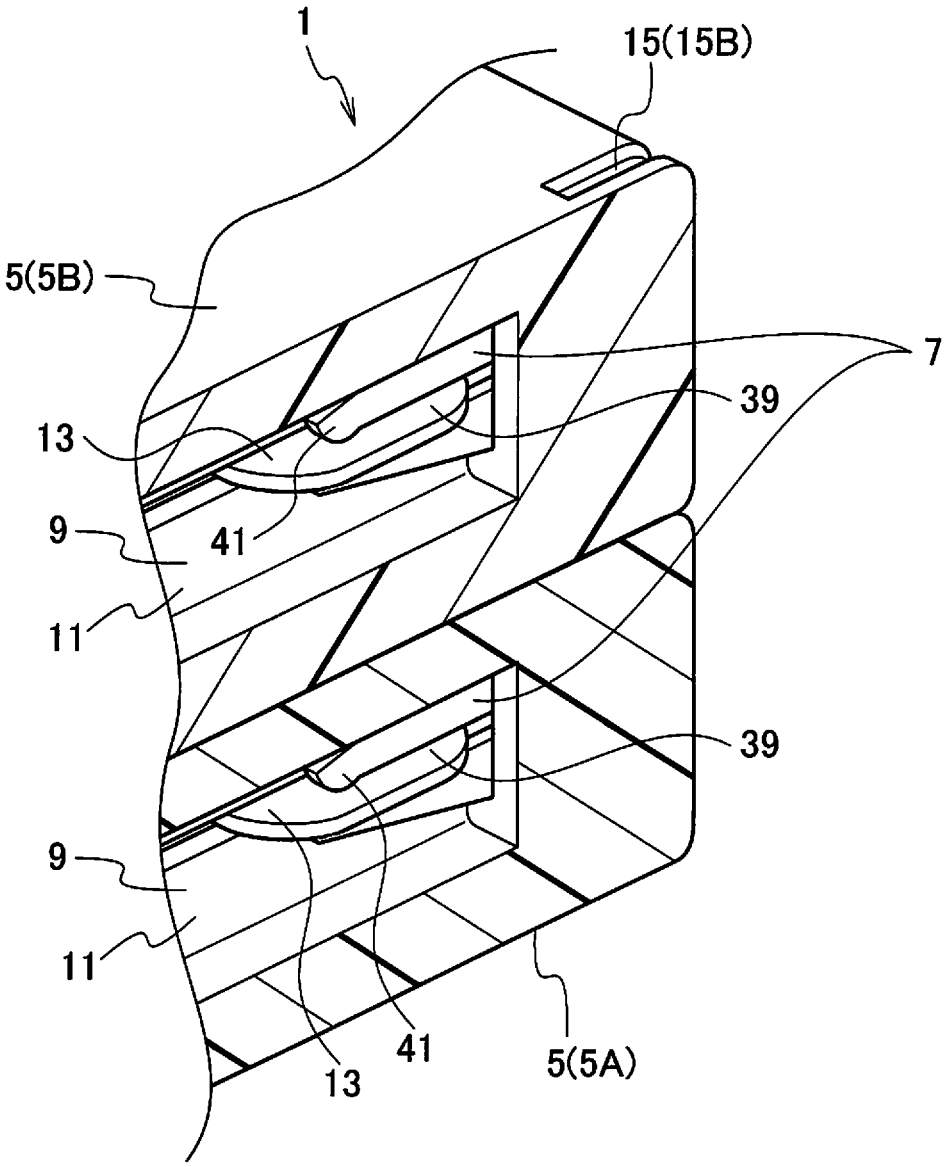
FIG. 5 is an enlarged view of the V-shaped part of FIG. 4.

The joint connector 7 is fit in the cutouts 15 (15A, 15B) of the respective housings 5 when the housings 5 (5A, 5B) are arranged on top of one another as illustrated in FIGS. 2 to 4. The arrangement of the housings 5 (5A, 5B) on top of one another more specifically means that the second housing 5B is laid on the first housing 5A in the longitudinal direction LD to integrate the housings 5A and 5B.

The joint connector 7 engages (contacts) with the male contact 13 of the connector terminal 3 housed in the first housing 5A and the male contact 13 of the connector terminal 3 housed in the second housing 5B to make the connector terminals 3 conductive, thereby integrating the housings 5A and 5B.

While the housings 5A and 5B are integrated, the integrated housings 5A and 5B are in a rectangular plate shape (rectangular parallelepiped shape), and the joint connector 7 does not protrude outside the rectangular-parallelepiped housings 5A and 5B.

As illustrated in FIG. 6, a female contact 17 is provided inside the main body 9 of the connector terminal 3. The housings 5 are omitted from FIG. 6.

As illustrated in FIG. 4 and the like, the housing 5 is provided with a plurality of housing holes 11 at predetermined intervals in the traverse direction TD. The connector terminals 3 are housed in the housing holes 11, respectively, so that the housing 5 houses the plurality of connector terminals 3 side by side in the traverse direction TD.

The male contacts 13 are engaged with the female contacts 17 so that the connector terminals 3 which are housed in the housing 5 and are mutually adjacent are mutually conducted.

The male contact 13 of the connector terminal (the rightmost connector terminal in FIG. 4) 3 present at one end of the traverse direction TD among the connector terminals 3 housed in the housing 5 is visible through the cutout 15 formed on the housing 5 (i.e. visible from the outside of the housing 5).

The joint connector 7 is configured to engage with the male contact 13 of the connector terminal 3 present at one end of the traverse direction TD of the first housing 5A and the male contact 13 of the connector terminal 3 present at one end of the traverse direction TD of the second housing 5B.

The connector terminal 3 is manufactured by forming, for example, a plate-shape metal material into a predetermined shape and bending the material formed in the predetermined shape.

As illustrated in FIG. 2 and the like, an outer shape of the connector terminal 3 substantially has a square pillar shape. The connector terminal housing 5 is present on the forward side FR in the forward/rearward direction FRD of the connector terminal 3 (more specifically, keeps a predetermined proper posture at a predetermined proper position away from the connector terminal 3), and then the connector terminal 3 is moved toward the forward direction FR so that the connector terminal 3 is inserted and housed in the housing hole 11 in the connector terminal housing 5 and is integrally installed in the connector terminal housing 5.

The connector terminal 3 comprises the main body 9, the male contact (male terminal part) 13, the female contact (female terminal part) 17, and a slit (side slit) 21 as described above.

The main body 9 is formed in a rectangular tube shape. The main body 9 in a rectangular tube shape comprises four sidewalls each formed in a rectangular plate shape (a first sidewall 19A, a second sidewall 19B, a third sidewall 19C, and a fourth sidewall 19D).

The first sidewall 19A is positioned on one side of the traverse direction TD of the main body 9. The second sidewall 19B is opposite to the first sidewall 19A and is positioned on the other side of the traverse direction TD of the main body 9. The third sidewall 19C is positioned on one side of the longitudinal direction LD of the main body 9. The fourth sidewall 19D is opposite to the third sidewall 19C and is positioned on the other side of the longitudinal direction LD of the main body 9.

The male contact 13 protrudes on one side TD1 of the traverse direction LD from the first sidewall 19A of the main body 9. The male contact 13 is formed in a plate shape, for example, its thickness direction is the longitudinal direction LD, it is positioned in the middle of the main body 9 in the longitudinal direction LD and is positioned on the forward side FR of the main body 9 in the forward/rearward direction FRD.

As illustrated in FIG. 6, the female contact 17 is provided inside the main body 9. The female contact 17 comprises an abutment part 23 and a spring 24. The abutment part 23 is formed to protrude inward from the third sidewall 19C of the main body 9. The spring 24 is formed to protrude inward from the fourth sidewall 19D of the main body 9. Thereby, the abutment part 23 is positioned on one side of the longitudinal direction LD and the spring 24 is positioned on the other side of the longitudinal direction LD.

The slit 21 is provided on the second sidewall 19B of the main body 9. The slit 21 is positioned in the middle of the main body 9 in the longitudinal direction LD, and extends in the forward/rearward direction FRD from the front end of the main body 9 (the second sidewall 19B) toward the rear end by a predetermined length. The slit 21 does not penetrate through the second sidewall 19B.

A value of the width of the slit 21 (a dimension in the longitudinal direction LD) is tapered to be larger from the front end toward the vicinity. The value of the width of the slit 21 at a part other than the tapered part is larger than a value of the thickness of the male contact 13 (a dimension in the longitudinal direction LD). The slit 21 is positioned at the same position as the male contact 13 in the longitudinal direction LD. That is, the center position of the slit in the longitudinal direction LD matches with the center position of the male contact in the longitudinal direction LD.

The connector terminal 3 is provided with an electric wire connection part 25. The electric wire connection part 25 protrudes toward the rearward side RR from the main body 9.

The electric wire connection part 25 comprises a conductive wire holding part 27 for holding a conductive wire of the electric wire 43 whose cover is removed and exposed, and a cover holding part 29 for holding the cover of the electric wire 43. The conductive wire holding part 27 and the cover holding part 29 are fastened to each other thereby to be integrally installed on the end of the electric wire 43 and to hold the electric wire 43 (not illustrated).

As described above, a plurality of housing holes 11 are provided so that a plurality of connector terminals 3 are arranged side by side in the traverse direction TD in one connector terminal housing 5 at the same time. The arranged connector terminals 3 are mutually engaged (mutually contacted) to be conducted. Further, the adjacent connector terminals 3 arranged in the connector terminal housing 5 side by side in the traverse direction TD are mutually contacted to be conducted.

With a more explanation, when a plurality of connector terminals 3 are arranged in the connector terminal housing 5 side by side in the traverse direction TD at the same time, for the mutually adjacent connector terminals 3, the male contact 13 of one connector terminal 3 is engaged with the female contact 17 of the other connector terminal 3 so that the mutually adjacent connector terminals 3 are conducted (see FIG. 6).

That is, the male contact 13 of one connector terminal 3 is sandwiched between the abutment part 23 and the spring 24 in the female contact 17 of the other connector terminal 3 due to an energizing force so that the male contact 13 of one connector terminal 3 is accurately engaged with the female contact 17 of the other connector terminal 3.

When a plurality of connector terminals 3 are arranged in the connector terminal housing 5 side by side in the traverse direction TD at the same time, the male contact 13 of one connector terminal 3 present at one end of the traverse direction TD is not adjacent to a connector terminal 3 and thus is not engaged with the female contact 17.

When a plurality of connector terminals 3 are arranged in the connector terminal housing 5 side by side in the traverse direction TD at the same time, the female contact 17 of one connector terminal 3 present at the other end of the traverse direction TD is not adjacent to a connector terminal 3 and thus is not engaged with the male contact 13.

When a plurality of connector terminals 3 are arranged in the connector terminal housing 5 side by side in the traverse direction TD at the same time, the male contact 13 of the connector terminal 3 passes through a throughhole (not illustrated) provided on a partitioning wall of the hosing 5 (a partitioning wall provided between the housing holes 11) to be engaged with the female contact 17 of the connector terminal 3 installed in the adjacent housing hole 11.

The joint connector 7 is used for laying the second housing 5B on the first housing 5A and mutually jointing them as described above. The joint connector 7 comprises a first engagement part 33, a second engagement part 35 and a coupling part 37, and is formed in a U-shape (see FIG. 2 and the like).

The first engagement part 33 in the joint connector 7 fits in the cutout (slit) 15A of the first housing 5A to engage with the male contact 13 of the connector terminal (the closest connector terminal to one end TD1 of the traverse direction TD) 3 housed in the first housing 5A.

The second engagement part 35 in the joint connector 7 fits in the cutout (slit) 15B of the second housing 5B to engage with the male contact 13 of the connector terminal (the closest connector terminal to one end TD1 of the traverse direction TD) 3 housed in the second housing 5B.

The coupling part 37 in the joint connector 7 is between the first engagement part 33 and the second engagement part 35 to connect the first engagement part 33 and the second engagement part 35.

When the joint connector 7 is installed in the housings 5A and 5B laid on top of one another, it entirely fits in the cutouts 15 in the housings 5A and 5B to conduct the connector terminals 3, thereby integrating the housings 5A and 5B.

As described above, the housing 5 is formed in a rectangular plate shape and its thickness direction is the longitudinal direction LD. The housing holes 11 are provided from the rear end face toward the forward side FR in the forward/rearward direction FRD.

The connector terminals 3 (the main bodys 9 and the like) housed in the housing holes 11 are locked on lances (not illustrated) provided in the housing holes 11 to be fixed on the housings 5.

While the connector terminal 3 is housed in the housing hole 11, as illustrated in FIG. 3 and the like, the front end of the main body 9 of the connector terminal 3 is away from the front end of the housing 5 and the male contact 13 of the connector terminal 3 is positioned on the front end side of the main body 9.

The slit 15 of the housing 5 is provided near one end of the traverse direction TD of the housing 5 such that its width direction matches with the traverse direction TD of the housing 5. In the forward/rearward direction FRD of the housing 5, the slit 15 extends from the front face of the housing 5 toward the rearward side RR. The slit 15 penetrates through the housing 5 in the longitudinal direction LD of the housing 5.

The slit 15 leads to the housing hole 11 (where the male contact 13 of the connector terminal 3 is housed) closest to one end TD1 of the traverse direction TD of the housing 5. Thereby, when the housing 5 housing the connector terminal 3 therein is viewed from the forward side FR toward the rearward side RR, the male contact 13 of the connector terminal 3 housed in the housing hole 11 closest to one end TD1 of the traverse direction TD of the housing 5 is visible through the slit 15.

When the housings 5A and 5B laid on top of one another are viewed in the longitudinal direction LD, the total first housing 5A and the total second housing 5B are laid on top of one another including the slits 15.

The joint connector 7 is inserted in the slits 15 and is engaged with the male contacts 13 of the connector terminals 3 housed in the first housing 5A and the male contacts 13 of the connector terminals 3 housed in the second housing 5B to conduct the connector terminals 3, thereby integrating the housings 5A and 5B.

The joint connector 7 will be described in more detail.

The joint connector 7 comprises the first engagement part 33, the second engagement part 35 and the coupling part 37, and is formed in a U-shape by punching a plate-shape metal material.

A tip end of the first engagement part 33 is provided with a slit 39. A width of the slit 39 is substantially constant, but a pair of semicircular convex parts 41 is formed at the inlet of the slit 39 so that the width of the slit 39 is narrower at the inlet of the slit 39.

The part where the slit 39 is formed in the joint connector 7 is elastic.

While the joint connector 7 is inserted in the slits 15 in the housings 5, as illustrated in FIG. 3, the male contact 13 of the connector terminal 3 fits in the slit 39 and the male contact 13 is sandwiched by the part where the slit 39 is formed (a pair of convex parts 41) by a predetermined pressure. Thereby, while the joint connector 7 is inserted in the slits 15 in the housings 5, the joint connector 7 cannot be easily released from the housings 5 (the connector terminals 3 housed in the housings 5).

A procedure of assembling the connector terminals 3, the housings 5 and the joint connector 7 in the joint connector extending structure 1 will be described herein.

In an initial state, it is assumed that the connector terminals 3, the housings 5 and the joint connector 7 are separated from each other and the connector terminals 3 are installed for the electric wires 43.

In the initial state, the connector terminals 3 are installed in the housings 5 (5A, 5B). Subsequently, the housings 5 (5A, 5B) are laid on top of one another. Then, the joint connector 7 is installed in the housings 5, and the assembly ends.

According to the joint connector extending structure 1, the joint connector 7 conducts the male contacts 13 of the connector terminals 3 housed in the first housing 5A and the male contacts 13 of the connector terminals 3 housed in the second housing 5B to integrate the housings 5. Thereby, the number of housings 5 is increased thereby to cope with mutual connection between more connector terminals 3. Further, more connector terminals 3 can be mutually connected without changing the number of housing holes 11 for housing the connector terminals 3 (without changing the specification of the housings 5). Then, the use forms of the housings 5 can be extended.

According to the joint connector extending structure 1, the joint connector 7 is configured to engage with the male contact 13 of the connector terminal 3 present at one end of the traverse direction TD of the first housing 5A and the male contact 13 of the connector terminal 3 present at one end of the traverse direction TD of the second housing 5B. Thereby, the male contacts 13, which are not used and left when a plurality of connector terminals 3 are mutually connected by only one housing 5, can be effectively used.

The above-described joint connector 7 is used, and additionally the engagement parts maybe provided at the other ends TD2 in the longitudinal direction TD of the housings 5A and 5B to mutually engage the engagement parts and to fix the housings 5A and 5B at both sides, thereby achieving more accurate engagement.

The two housings 5 are laid on top of one another in the above description, but three or more housings 5 may be laid on top of one another. In this case, the three or more housings 5 may be integrated by forming the joint connector 7 in an E-shape, or changing the form of the slits 15 provided in the housings 5, using a plurality of joint connectors 7.

Although the embodiments of the present invention has been described above, the invention is not limited to the above embodiment, and various modifications are possible.

What is claimed is:

1. A joint connector extending structure comprising:

a plurality of connector terminals each having a main body and a male contact protruding from the main body at one side of a traverse direction of the main body;

a first housing for housing a first connector terminal of the plurality of connector terminals and having a first cutout through which the male contact of the first connector terminal housed in the first housing is visible;

a second housing for housing a second connector terminal of the plurality of connector terminals and having a second cutout through which the male contact of the second connector terminal housed in the second housing is visible; and a joint connector configured to fit in the first and second cutouts of the first and second housings laid on top of one another in a longitudinal direction perpendicular to the traverse direction to engage with the male contact of the first connector terminal housed in the first housing and the male contact of the second connector terminal housed in the second housing thereby to conduct the first and second connector terminals and integrate the first and second housings, wherein the first and second cutouts of the first and second housings laid on top of one another in the longitudinal direction are in communication with each other in the longitudinal direction.

2. The joint connector extending structure according to claim 1, wherein each of the plurality of connector terminals has a female contact inside the main body, the first housing houses the first connector terminal and a third connector terminal of the plurality of connector terminals adjacently in the traverse direction, the male contact of the first connector terminal housed in the first housing and the female contact of the third connector terminal housed in the first housing are engaged with each other to be conducted, the male contact of the first connector terminal housed in the first housing is positioned at one end of the traverse direction of the first housing, and the male contact of the second connector terminal housed in the second housing is positioned at one end of the traverse direction of the second housing.

3. The joint connector extending structure according to claim 1, wherein the joint connector has a U-shape.

4. The joint connector extending structure according to claim 1, wherein the joint connector is configured to entirely fit in the first and second cutouts of the first and second housings laid on top of one another in the longitudinal direction.

5. The joint connector extending structure according to claim 1, wherein the first and second housings are laid on top of one another and integrated such that the integrated first and second housings are in a rectangular parallelepiped shape and the joint connector does not protrude outside the rectangular-parallelepiped shape of the first and second housings.

6. The joint connector extending structure according to claim 1, wherein the plurality of connector terminals are arranged in the first and second housings side by side in the traverse direction at the same time such that the male contact of mutually adjacent ones of the plurality of connector terminals is engaged with a female contact of mutually adjacent other ones of the plurality of connector terminals so that the mutually adjacent connector terminals are conducted.

7. The joint connector extending structure according to claim 6, wherein the male contact of the mutually adjacent ones of the plurality of connector terminals is sandwiched between an abutment part and a spring of the female contact of the other of the mutually adjacent ones of the plurality of connector terminals due to an energizing force so that the male contact is accurately engaged with the female contact.

8. The joint connector extending structure according to claim 1, wherein the plurality of connector terminals are arranged in the first and second housings side by side in the traverse direction at the same time such that the male contact of one of mutually adjacent ones of the plurality of connector terminals at one end of the first and second housings in the traverse direction is not adjacent to a connector terminal and is therefore not engaged with a female contact.

9. The joint connector extending structure according to claim 8, wherein the plurality of connector terminals are arranged in the first and second housings side by side in the traverse direction at the same time such that the female contact of one of mutually adjacent ones of the plurality of connector terminals at the other end of the first and second housings in the traverse direction is not adjacent to a connector terminal and is therefore not engaged with a male contact.

10. The joint connector extending structure according to claim 1, wherein the joint connector comprises:

a first engagement part configured to fit in the first cutout of the first housing to engage with the male contact of the first connector terminal housed in the first housing;

a second engagement part configured to fit in the second cutout of the second housing to engage with the male contact of the second connector terminal housed in the second housing; and a coupling part connecting the first engagement part and the second engagement part, wherein the joint connector installed in the first and second housings entirely fits in the first and second cutouts of the first and second housings to conduct the first and second connector terminals and integrate the first and second housings.

11. The joint connector extending structure according to claim 1, wherein the first and second cutouts are provided respectively near one end of the traverse direction of the first and second housings such that a width direction of the first and second cutouts matches the traverse direction of the first and second housings.

12. The joint connector extending structure according to claim 1, wherein the first and second cutouts extend respectively from a front face of the first and second housings toward a rearward side, and penetrate through the first and second housings in a longitudinal direction of the first and second housings.

13. A joint connector used for laying and jointing on top of one another a first housing and a second housing, the first housing being for housing a first connector terminal of a plurality of connector terminals each having a main body and a male contact protruding from the main body at one side of a traverse direction of the main body and having a first cutout through which the male contact of the first connector terminal as housed is visible, the second housing being for housing a second connector terminal of the plurality of connector terminals and having a second cutout through which the male contact of the second connector terminal as housed is visible, the joint connector comprising:

a first engagement part configured to fit in the first cutout of the first housing to engage with the male contact of the first connector terminal housed in the first housing;

a second engagement part configured to fit in the second cutout of the second housing to engage with the male contact of the second connector terminal housed in the second housing; and a coupling part connecting the first engagement part and the second engagement part, wherein the joint connector installed in the first and second housings entirely fits in the first and second cutouts of the first and second housings to conduct the first and second connector terminals and integrate the first and second housings.

14. The joint connector according to claim 13, wherein the joint connector has a U-shape.

15. The joint connector according to claim 13, wherein the first and second cutouts of the first and second housings laid on top of one another in a longitudinal direction perpendicular to the traverse direction are in communication with each other in the longitudinal direction.

16. The joint connector of claim 13, wherein a tip end of at least the first engagement part is provided with a slit.

17. The joint connector of claim 16, a width of the slit is substantially constant.

18. The joint connector of claim 16, wherein the tip end of at least the first engagement part where the slit is provided is elastic.

19. The joint connector of claim 16, wherein the slit comprises a pair of semicircular convex parts formed at an inlet of the slit so that the width of the slit at the pair of semicircular convex parts is narrower than a width of the slit at a part other than the pair of semicircular convex parts.

20. The joint connector of claim 19, wherein when the first engagement part fits in the first cutout of the first housing to engage with the male contact of the first connector terminal housed in the first housing, the male contact of the connector terminal fits in the slit and is sandwiched between the pair of semicircular convex parts.

* * * * *